US005269394A

United States Patent [19]

Haroldson, Sr.

[11] Patent Number: 5,269,394

[45] Date of Patent: Dec. 14, 1993

[54] UNIVERSAL BRACKET APPARATUS FOR ATTACHING TOE BOARDS TO SCAFFOLDS

[76] Inventor: Acey A. Haroldson, Sr., 14025 NW. 23rd Ave., West Des Moines, Iowa 50265

[21] Appl. No.: 886,421

[22] Filed: May 20, 1992

[51] Int. Cl.[5] ..... E04G 5/00

[52] U.S. Cl. ..... 182/113; 248/231.5; 248/230

[58] Field of Search ..... 182/178, 179, 113; 248/230, 231.5; 256/59; 52/638

[56] References Cited

U.S. PATENT DOCUMENTS

| | | | |
|---|---|---|---|
| 1,955,074 | 4/1930 | Knupp | 182/178 X |
| 3,752,262 | 8/1973 | Helms | 256/39 X |
| 4,439,052 | 3/1984 | Wallther . | |
| 4,577,449 | 3/1986 | Celli | 187/179 X |
| 4,594,019 | 6/1986 | Maleci et al. . | |
| 5,028,164 | 7/1991 | Williams . | |
| 5,078,532 | 1/1992 | Williams . | |

FOREIGN PATENT DOCUMENTS

| | | | |
|---|---|---|---|
| 59154 | 9/1982 | European Pat. Off. | 182/113 |
| 783449 | of 0000 | U.S.S.R. | 182/113 |

OTHER PUBLICATIONS

Copy—6 sheets from Scaffold Service Incorporated catalog showing prior art.

*Primary Examiner*—Alvin C. Chin-Shue
*Attorney, Agent, or Firm*—Henderson & Sturm

[57] ABSTRACT

A universal apparatus for attachment to each corner of a scaffold vertical member and having toe board holding flanges attached thereto for receiving the ends of toe boards therein. The bracket is of a type which can be opened by a hinge and disposed around a vertical scaffold member and then locked in place whereby it has universal application to almost any standard scaffold structure. The toe boards themselves are typically constructed of lumber which would be on the construction site anyway, such as 2"×6" members which can be cut to a desired length.

6 Claims, 2 Drawing Sheets

UNIVERSAL BRACKET APPARATUS FOR ATTACHING TOE BOARDS TO SCAFFOLDS

TECHNICAL FIELD

The present invention relates generally to toe boards for scaffolds and more particularly to a universal toe board bracket for attaching toe boards to scaffolds.

BACKGROUND ART

Scaffolds of a type which are used at construction sites or the like typically have vertical and horizontal members attached together and at least one floor elevated above the ground for supporting workers and for supporting tools and other materials to be used by such workers.

Since there are often people working on the ground or below the elevated platform of the scaffold, there have been many accidents caused by workers on the platform which inadvertently knock objects off of the floor of the scaffold. Because there are often workers below, these tools or other objects can, of course, land on someone working below, thereby injuring them. Since this problem is a longstanding one, toe boards have been devised for solving the problem. These toe boards generally consist of something that extends from the elevated floor of the scaffold to a few inches above the floor so that when workers thereon drop something or scoot things around with their feet, these tools or objects or other items will not drop off of an edge of the elevated floor.

Various types of clamps have been devised for attaching these toe boards to a scaffold. Also, panels, resembling a fence or the like with guard rails sometimes include a lower toe board section and then these guard rails or panels are connected together, one on each edge of the elevated platform. Certain toe boards are made of a specified length and therefore are not adjustable.

One of the problems with the prior art is that the solutions tend to be quite expensive and not necessarily universal in their application. Consequently, there is a need for a toe board attaching apparatus which overcomes the aforementioned problems.

DISCLOSURE OF THE INVENTION

The present invention relates generally to a universal apparatus for attachment to each corner of a scaffold vertical member and having toe board holding flanges attached thereto for receiving the ends of toe boards therein. The bracket is of a type which can be opened by a hinge and disposed around a vertical scaffold member and then locked in place whereby it has universal application to almost any standard scaffold structure. The toe boards themselves are typically constructed of lumber which would be on the construction site anyway, such as 2"×6" members which can be cut to any desired length.

An object of the present invention is to provide an improved apparatus for attaching toe boards to a scaffold structure.

Another object of the present invention is to provide a universal toe board attachment apparatus for scaffolds.

A still further object of the present invention is to provide a universal scaffold bracket which is easy to use, economical to produce and which is dependable.

Other objects, advantages, and novel features of the present invention will become apparent from the following detailed description of the invention when considered in conjunction with the accompanying drawings.

BEST MODES FOR CARRYING OUT THE INVENTION

Figure 1:
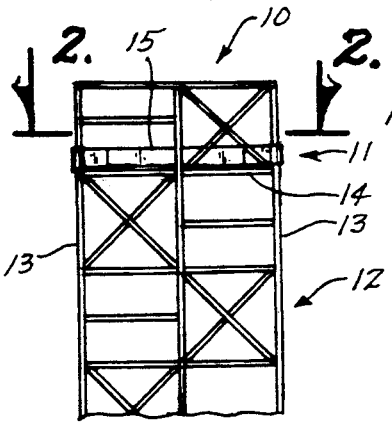
FIG. 1 shows a scaffold having elevated floor and having the universal brackets of the present invention holding toe boards thereon.

Referring now to the drawings wherein like reference numerals designate identical or corresponding parts throughout the several views, FIG. 1 shows a scaffold apparatus (10) having a plurality of vertical, horizontal and brace members indicated generally as (12) in FIG. 1.

Figure 3:
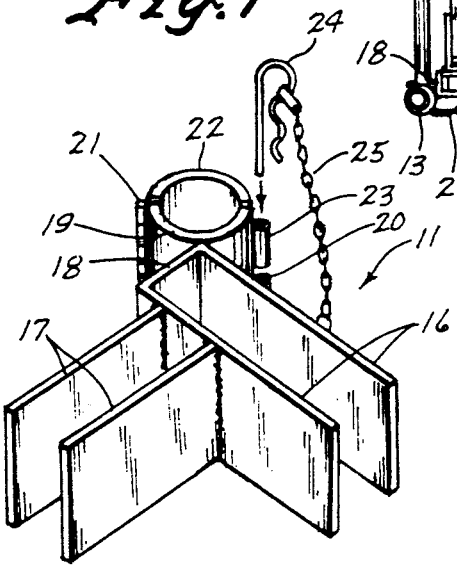
FIG. 3 is a perspective view of a preferred embodiment of the present invention showing the universal toe board bracket with the toe boards removed.

Brackets (11), shown in FIG. 3 in detail, are attached to each of the corner vertical members (13) and these brackets (11) rest on a floor (14). A plurality of toe boards (15) extend into slots in each pair of flanges (16) and (17) of each apparatus (11).

The flanges (17) are welded to one of the flanges (16), and the flanges (16) are coupled together by a member (18) at one end thereof. The pair of flanges (16) with its connector member (18) are welded to semi-cylindrical member (19). This semi-cylindrical member (19) has a smaller cylindrical member (20) welded to one side thereof.

A hinge (21) is connected to the other side of the semi-cylindrical member (19) and a second semi-cylindrical member (22) is connected to the hinge (21) so that the member (22) can pivot with respect to the member (19). The member (22) also has a small cylindrical member (23) thereon for reasons which will be discussed below.

Figure 5:
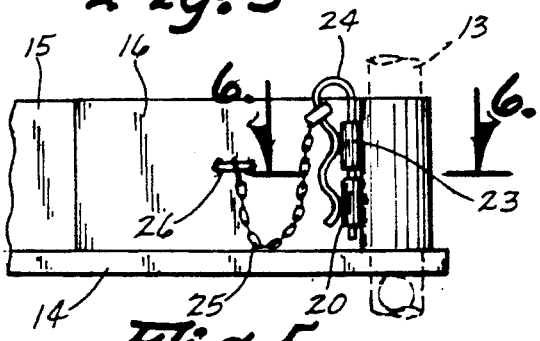
FIG. 5 is a view taken along line 5—5 of FIG. 4.

Referring now to FIG. 5, it is noted that a pin (24) is attached by a chain (25) to a U-shaped member (26), welded to one of the flanges (16). The chain (25) and U-shaped member (26) are for the purpose of insuring that the pin (24) will always be there when needed.

Figure 2:
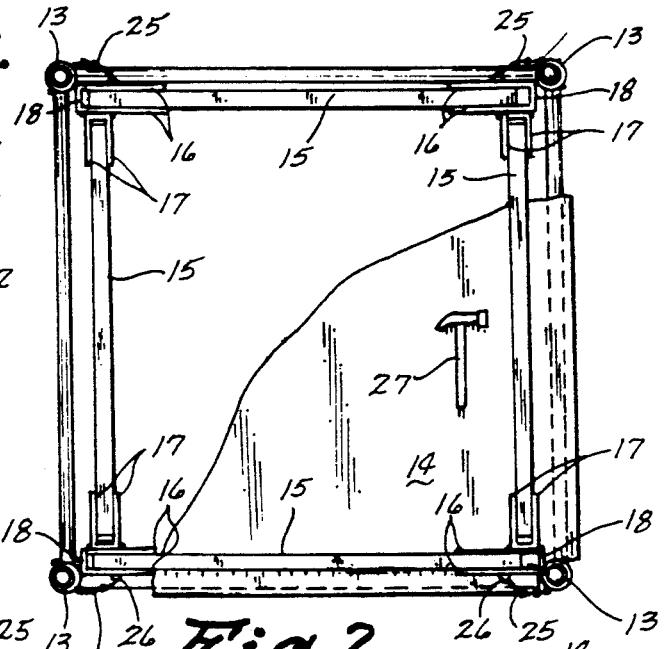
FIG. 2 is a view taken along line 2—2 of FIG. 1.
Figure 6:
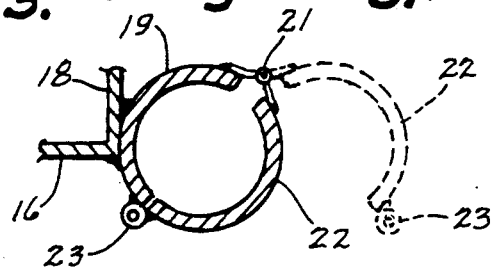
FIG. 6 is an enlarged cross sectional view taken along 6—6 and showing the apparatus in solid lines in a closed position and showing the connector open in dashed lines wherein it could be disposed around a vertical member of a scaffold.

In operation of the apparatus (11) shown in FIG. 3, once the scaffold (12) has been erected, the floor (14)

would be positioned to rest on horizontal portions of the scaffold (12), as shown in FIGS. 1 and 2. Once the elevated floor (14) is in place, one of the devices (11) would be attached to each corner vertical member, as shown in FIG. 2. This is done by first removing the pin (24) and pivoting the member (22) to the position shown in FIG. 7, whereupon the apparatus (11) is moved around one of the vertical members (13), as shown in FIG. 4, and then closed to the position shown in FIGS. 3, 4 and 6.

Figure 4:
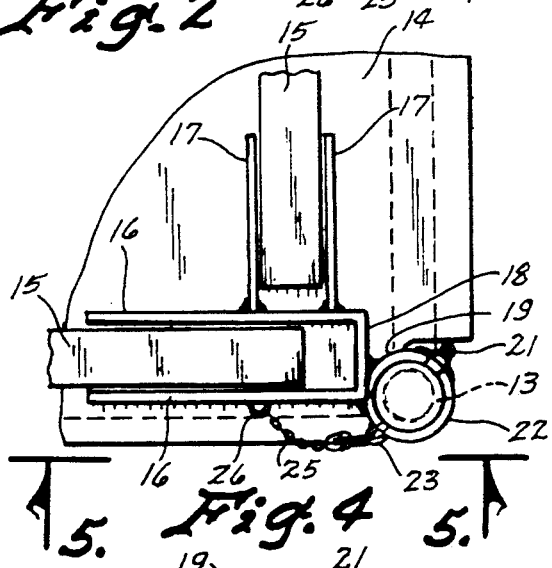
FIG. 4 is an enlarged view similar to FIG. 2 but showing only one corner of the apparatus of FIG. 2 with the toe boards inserted and resting on top of an elevated floor.

Once the member (22) is moved to the closed position shown in FIGS. 3 and 4, the pin (24) is inserted through the holes in members (20) and (23), as shown in FIGS. 3, 4 and 5. The pin (24) will consequently lock the member (22) in place so that it cannot pivot with respect to the member (19). After one of the brackets (11) is attached in the aforementioned way to each of the vertical scaffold members (13), toe boards (15), which can be 2" by 6" wooden members of an appropriate length, can be easily slid into each of the slots between the paired flanges (16) and between the paired flanges (17), as shown in FIGS. 2 and 4. Consequently, the toe boards (15) will be held in place in a simple and effective manner which will prevent items such as the hammer (27), shown in FIG. 2, from being knocked off of one of the edges of the floor (14) during the construction process.

Figure 8:
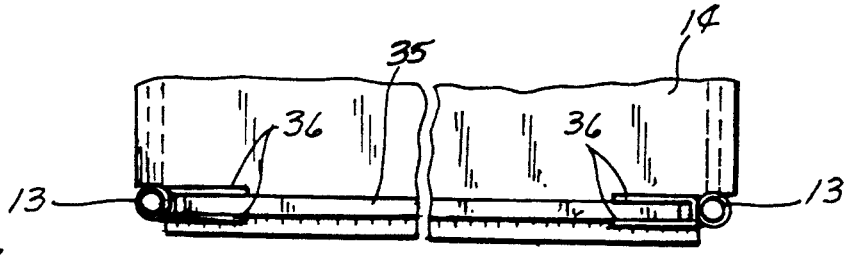
FIG. 8 is a partial top elevational view of another preferred embodiment of the present invention for holding only one toe board.
Figure 9:
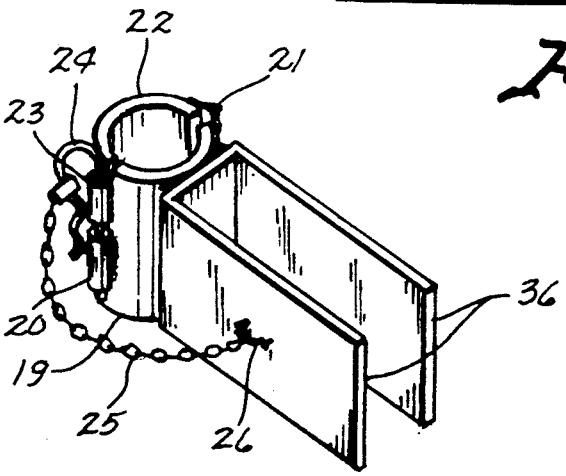
FIG. 9 is a perspective view of the apparatus of FIG. 8 showing one universal toe board attaching apparatus for receiving only one end of one toe board.

Referring now to FIG. 9, a second embodiment (31) is shown having a single pair of flanges (36) for receiving a toe board (35), as shown in FIG. 8. The other portion of the bracket (31) is exactly like the bracket (11) and has been numbered accordingly to show identical parts. For example, member (19) has a locking cylinder (20). Semi-cylindrical member (22) is attached by a hinge (21) to semi-cylindrical member (19) and has a locking cylinder (23) welded thereto. The pin (24) is attached by a chain (25) to U-shaped member (26), which is welded to one of the flanges (36).

Figure 7:
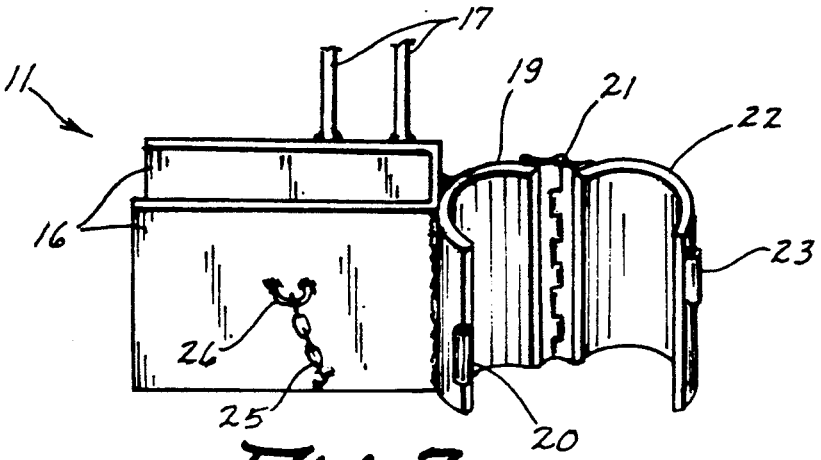
FIG. 7 is a perspective of the preferred embodiment shown with the hinge portion open in preparation for being received around the vertical member of a scaffold.

In operation of the embodiment (31) shown in FIG. 9, the pin (24) can be removed from the position shown in FIG. 9 and the semi-cylindrical member (22) opened up to the position shown by the embodiment (11) shown in FIG. 7. Once the member (22) has been opened, the bracket (31) can be attached to the vertical member (13) of a scaffold (12) as described above with respect to the apparatus (11). Once the apparatus (31) has been attached to vertical member (13) by pivoting the member (22) back to the position shown in FIG. 9 and reinserting pin (24) through members (20) and (23), a wooden toe board (35) can be inserted at each end thereof between the pair of slotted members (36) as shown in FIG. 8. This will provide a toe board for any edge of any floor (14) which needs toe board protection.

Accordingly, it will be appreciated that the preferred embodiments shown herein do indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. An apparatus for use with a scaffold of a type including a plurality of elongated vertical members interconnected by a plurality of horizontal members and an elevated floor disposed between said vertical members for supporting a person and items to be used by such a person, said apparatus comprising:

a first slotted flange for receiving one end of a toe board therethrough a second slotted flange disposed perpendicular to and connected directly to one side of said first slotted flange for receiving one end of a toe board therethrough; and connector means attached to said first slotted flange for selectively connecting said first slotted flange to one of said vertical members.

2. The apparatus of claim 1 wherein said connector means comprises:

a first closure member; and a second closure member pivotally attached to said first closure member and moveable between a first closed position wherein said first and second closure members extend at least partially on opposite sides of said first vertical member respectively, and a second open position.

3. The apparatus of claim 2 wherein said connector means further comprises:

locking means for selectively locking said second closure member into the first closed position with respect to said first closure member whereby said first connector means will hold the first holding means in place and permitting said first holding means to be removed by first unlocking and then opening said second closure member with respect to the first closure member.

4. Apparatus for use with a scaffold of a type including a plurality of elongated vertical members interconnected by a plurality of horizontal members and an elevated floor disposed between said vertical members for supporting a person and items to be used by such a person, said apparatus comprising:

first and second toe board means for substantially preventing said items from falling off an edge of said floor wherein said first and second toe board means each comprise a first generally U-shaped holding means for receivably holding the opposite ends of a first toe board in a vertical orientation on said floor; wherein, said first holding means comprises a first pair of rigid flanges disposed parallel to one another and connected on one end by a rigid connector member; and, a second holding means for receivably holding an end of other toe boards in a vertical orientation on said floor; wherein, said second holding means comprises a second pair of rigid flanges disposed parallel to one another and connected directly to one side of said first pair of rigid flanges in a perpendicular fashion; and first connecting means operatively attached to said first holding means for removably encircling a pair of spaced vertical members whereby said first holding means is held close to each one of said pair of vertical members;

5. The apparatus of claim 4 wherein said first connector means comprises:

a first closure member; and a second closure member pivotally attached to said first closure member and moveable between a first closed position wherein said first and second closure members extend at least partially on opposite sides of said pair of vertical members respectively, and a second open position.

6. The apparatus of claim 5 including locking means for selectively locking said second closure member into the first closed position with respect to said first closure member whereby said first connector means will hold the first holding means in place and permitting said first holding means to be removed by first unlocking and then opening said second closure member with respect to the first closure member.

* * * * *